US005144542A

United States Patent [19]

Puglisi

[11] Patent Number: 5,144,542

[45] Date of Patent: Sep. 1, 1992

[54] RETRACTABLE LIGHT FIXTURE

[76] Inventor: Daniel G. Puglisi, 476 Copperstone Cir., Casselberry, Fla. 32707

[21] Appl. No.: 806,103

[22] Filed: Dec. 13, 1991

[51] Int. Cl.[5] ..... F21S 1/00

[52] U.S. Cl. ..... 362/386; 362/153.1; 362/286; 362/364

[58] Field of Search ..... 362/153.1, 802, 386, 362/364, 286

[56] References Cited

U.S. PATENT DOCUMENTS 5,003,441 3/1991 Crowe et al. ..... 362/286
5,075,834 12/1991 Puglisi ..... 362/153.1

FOREIGN PATENT DOCUMENTS 0188143 3/1937 Switzerland ..... 362/286
0304048 1/1929 United Kingdom ..... 362/386

*Primary Examiner*—Allen M. Ostrager
*Assistant Examiner*—Alan B. Cariaso
*Attorney, Agent, or Firm*—William M. Hobby, III

[57] ABSTRACT

A retractable light fixture apparatus has a housing having sides and a bottom and having an open end covered by a cover and having a lamp and reflector attached to the cover. An electrically actuated lamp solenoid is attached inside the housing and has a solenoid arm attached to the cover and lamp for raising the lamp and cover from inside the housing when the solenoid is in an extended position and for lowering the lamp and cover back onto the housing when the lamp solenoid arm is lowered. An electrical conductor is connected from an electrical power source to the lamp solenoid and to the lamp for powering the lamp and solenoid. The solenoid has a casing having a coil attached therearound for at least a portion of the length of the casing for generating a magnetic field in the casing for driving a slidable piston having the extendable solenoid arm attached to one end thereof. The solenoid arm latching system holds the solenoid arm in an extended position and includes a solenoid arm guide and stop member placed in one end of the solenoid casing and having a coil formed therearound to produce an electrical magnet in the stop member for holding the solenoid arm in an extended position when the solenoid slidable piston is adjacent to the stop member. The solenoid slidable piston is positioned to also act as a damper during the raising and lowering of the cover and lamp while the solenoid stop member also acts as a guide for centering the solenoid arm.

19 Claims, 1 Drawing Sheet

RETRACTABLE LIGHT FIXTURE

BACKGROUND OF THE INVENTION

This invention relates to light fixtures and particularly to light fixtures having a lamp movable between extended and retracted positions.

The use of exterior lighting has been quite popular in the United States and particularly in the sunbelt states of the United States where much activity takes place out of doors after dark because of the weather and where in lighting is used to accentuate the extensive decorative landscaping employed because of the favorable year round weather conditions. In recent years, low voltage lighting has become particularly popular for decorative lighting inasmuch as lower voltage and lower wattage bulbs provide a pleasant-like atmosphere with low power consumption and long life equipment. Most lighting fixtures employed for exterior lighting, however, utilizes ugly, inconvenient and, in many cases, unsafe lighting fixtures. Fixtures placed alone, adjacent a sidewalk or pathway present objects over which a person may fall when attention is not specifically directed thereto as by the lighting thereof. Mowing around such fixtures in a lawn becomes an inconvenient task requiring separate attention with hand shears or powered edger adapted for such use.

In the prior Bivens U.S. Pat. No. 4,180,850, a retractable light fixture adapted for decorative landscape lighting applications in which a retractable hollow cylinder carries a lightbulb which is retracted into a hollow body and which operates similar to a hydraulic piston mounted in a hydraulic cylinder housing and has a hydraulic line attached thereto for forcing the piston portion out of the housing to raise and lower the light. In the Bourne U.S. Pat. No. 4,974,134, an illuminated device having an underground storage position is provided which uses a clear lens to protect a lightbulb mounted in an inner housing which is telescoped upward within an outer housing buried in the ground when an electric motor is activated to drive a rotating screw which lifts the inner housing relative to the outer housing. A pair of microswitches turn the electric motor on and off when it reaches its limits. In the Arneson et al., U.S. Pat. No. 2,738,492, a signal light for automotive vehicles can be raised over the automobile for making a warning light, such as used on police cars and ambulances, more visible to warn other vehicles of a danger. In addition, there are numerous automobile lights which have retracted and raised positions to assist in improving the aerodynamics of the vehicle by having the headlight recessed when not in use. One such structure can be seen in the Matsuura et al. U.S. Pat. No. 4,432,040.

In contrast to these prior art devices, the present invention provides a simplified electrical circuit in a recessed lighting fixture which can be quickly installed and which is operated simply by turning the remote electrical switch on and off. When the switch is turned on, the light is automatically raised and turned on. When the electrical switch is turned off, the lighting fixture lamp is turned off and returned into the housing which is typically mounted in the earth. The complexities of utilizing separate fluid lines for raising and lowering a lamp fixture and the complexities of an electric motor driving a screw are eliminated with a simplified electro-mechanical circuit.

SUMMARY OF THE INVENTION

A retractable light fixture apparatus has a housing having sides and a bottom and having an open end covered by a cover and having a lamp and reflector attached to the cover. An electrically actuated lamp solenoid is attached inside the housing and has a solenoid arm attached to the cover and lamp for raising the lamp and cover from inside the housing when the solenoid is in an extended position and for lowering the lamp and cover back onto the housing when the lamp solenoid arm is lowered. An electrical conductor is connected from an electrical power source to the lamp solenoid and to the lamp for powering the lamp and solenoid. The solenoid has a casing having a coil attached therearound for at least a portion of the length of the casing for generating a magnetic field in the casing for driving a slidable piston having the extendable solenoid arm attached to one end thereof. The solenoid piston has a ledge formed on one end thereof around the attachment of the solenoid arm thereto which ledge may be generally a truncated cone-shape. The solenoid arm latching system holds the solenoid arm in an extended position and includes a solenoid arm guide and stop placed in one end of the solenoid casing and having a coil formed around the solenoid and the guide and stop member to produce an electrical magnet in the stop member for holding the solenoid arm in an extended position when the solenoid slidable piston is adjacent to the stop member. The stop member may have an internal generally truncated cone-shape to match the shape of the ledge on the slidable piston. The solenoid casing coil may be connected through a relay to the electric magnet coil to switch the power applied therethrough between the solenoid and the latching system whenever the lamp is raised. When the power is cut to the lamp and coil, the solenoid arm and coil will retract under the force of gravity. The solenoid slidable piston is positioned to also act as a damper during the raising and lowering of the cover and lamp while the solenoid stop member also acts as a guide for centering the solenoid arm.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
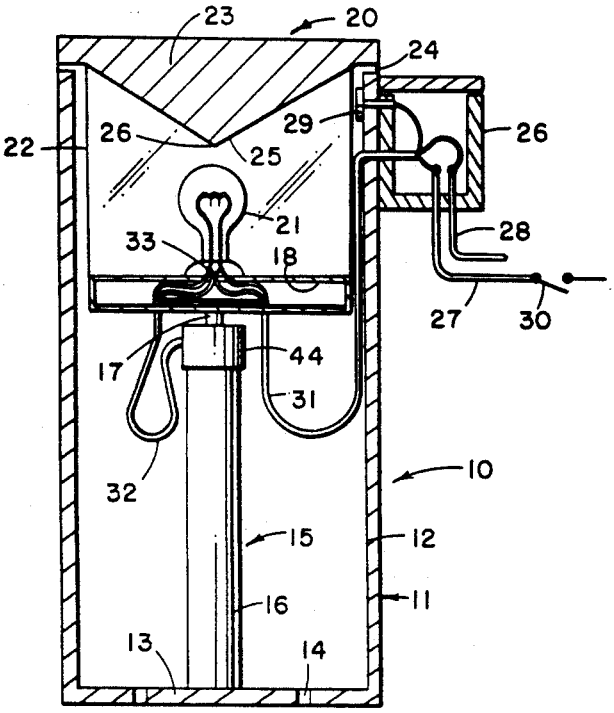
FIG. 1 is a sectional view of a retractable light fixture in accordance with the present invention in a retracted position.
Figure 2:
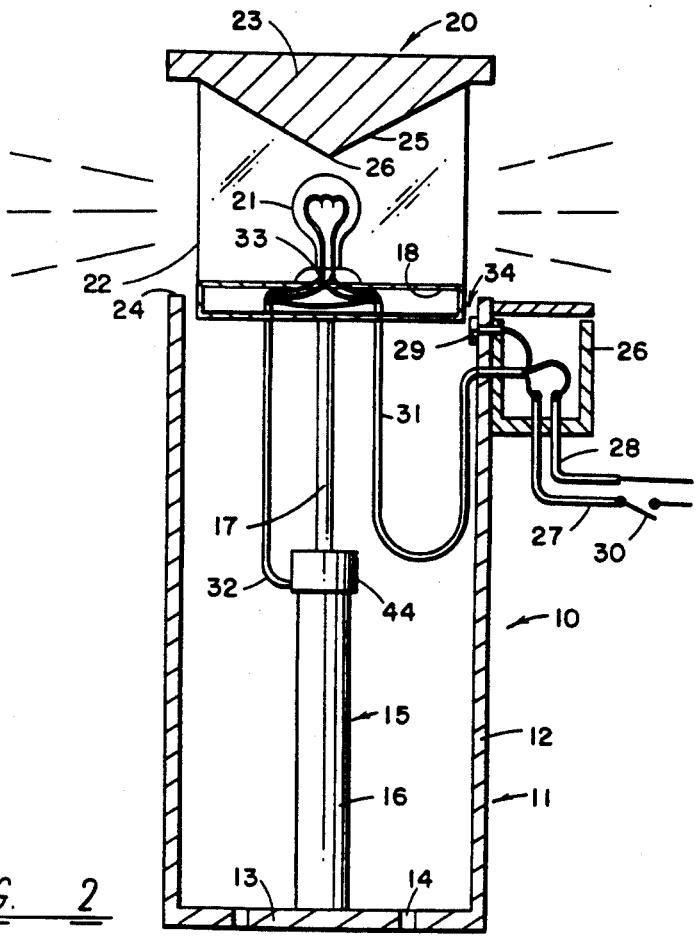
FIG. 2 is a sectional view of a retractable light in an extended position.

Referring to the drawings and especially to FIGS. 1 and 2, a retractable light fixture 10 is illustrated having a housing 11 having sides 12 and a bottom 13 with a plurality of drain holes 14 in the bottom 13. A solenoid 15 is attached in the housing 11 to the bottom 13 and has a solenoid casing 16 and a solenoid extendable arm 17. The solenoid arm is shown attached to the bottom 18 of a cover and lamp assembly 20. The bottom 18 has a lamp 21 attached thereto and a transparent lens 22 extending therearound with the cover portion 23 shaped to cover the top edge 24 of the housing 11. The cover portion 23 has a bottom side of a generally cone-shape 25 to act as a reflector for reflecting the light from the lamp 21. The lamp 21 is mounted directly beneath the case point 26 for directing light out the transparent lens 23 when the cover portion of lamp assembly 20 are in a raised position, as shown in FIG. 2.

An electrical box 26 is shown mounted to the side of the housing and has a pair of electrical conductors 27 and 28 connected therethrough. Conductor 27 is the hot line and has a remote switch 30 which can be a manual switch or a relay, such as a timer or the like. The conductors are connected to a pair of conductors 31 which are in turn connected to the lamp 21 for powering the lamp anytime the power is turned on by closing the switch 30. The power is connected through a conductor 32 from the lamp connection 33 to the solenoid 15 powering the solenoid to raise the lamp to a raised position. The microswitch 29 switches off the power to the solenoid 15 but leaves on the latching coil 44 to hold the lamps in a raised position as long as the power is turned on. Cutting the power by opening the switch 30 results in turning the light 21 off and deactivating the electromagnet 44 to drop the sliding solenoid arm 17 into the casing 16 which is retracted by the force of gravity but which could also be activated by a spring without departing from the spirit and scope of the invention.

Thus, in operation, the light fixtures of FIGS. 1 and 2 can be attached by burying the housing 11 in the earth and connecting the wiring 27 and 28 to the wiring 31 in the electrical box 26. Then the remote switch 30 can activate or deactivate the lamp 21 which simultaneously turns the lamp on and raises the lamp and cover assembly 20 and holds it in a raised position until the power is deactivated at which time the lamp 21 is turned off and the lamp and cover assembly 20 retracted to the position, shown in FIG. 1, covering the housing 11 open end 34 to protect the housing from weather.

Figure 3:
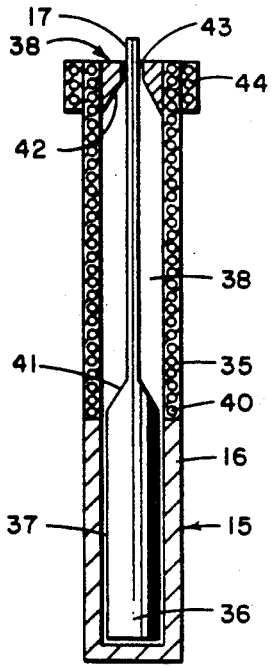
FIG. 3 is a sectional view of a solenoid for use in the light fixtures of FIGS. 1 and 2 in a retracted position.
Figure 4:
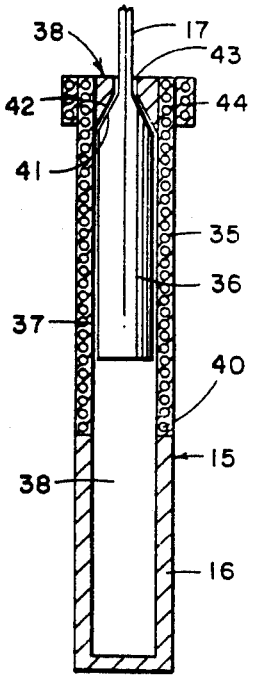
FIG. 4 is a sectional view of a solenoid of FIG. 3 in an extended position.

Turning to FIGS. 3 and 4, solenoid 15 is more clearly illustrated having the solenoid casing 16 which can be of a polymer material, if desired, having a solenoid coil 35 wound thereinside so that the casing 16 can be of a polymer material and more suitably of a self-lubricating polymer material. The solenoid has a slidable piston 36 with a small annular spacing 37 therearound sufficient to allow the passage of air within the hollow inside 38 of the solenoid casing 16 so that the air passing through the small spacing 37 tends to dampen the piston when the piston is either extended or retracted. The slidable piston 36 has a solenoid arm 17 attached to one end thereof so that the piston, when actuated, drives the rod to an extended position guided by a solenoid guide and stop member 38. The member 38 also acts as a stop to stop the extension of the piston 36 in a raised position, as shown in FIG. 4. Piston 36 may be made of a soft iron or the like and extends just above a bottom 40 of the coils 35 so that applying power to the coil will produce an electromagnetic field within the casing 16 which will drive the piston 36 to a raised position. Piston 36 has a generally truncated cone ledge 41 on one end where it attaches to the solenoid arm 17 while the stop member 38 has a generally truncated cone interior surface 42 shaped with a matching surface to the surface 41, so that in a raised position as in FIG. 4, the surface 41 and 42 fit together providing a greater surface area which stops the further extension of the piston 36. Stop member 38 has the guide opening 43 therethrough matched to fit the solenoid arm 17 for guiding the solenoid arm. The holding coil 44 may be more heavily wound if desired to produce a magnetic field in the stop member 38 converting it to an electric magnet to hold the piston 36 thereto in a raised latched position, as in FIG. 4. The coils 35 and 44 operate together when the power is turned on from the conductors 32 and a microswitch 29 switches the power to coil 35 off leaving coil 44 turned on when the cover assembly 20 reaches a raised position to thereby switch to a latching position.

In operation, the power used by the coil 44 is minimal once the lamp and cover assembly 20 are raised and the assembly is held in position until the power is cut to the lamp 21 at which time the coils are deactivated and the weight of the piston 36, arm 17, and the cover and housing assembly 20 provide the mass to return to the solenoid to the retracted position, as in FIG. 3, and to the retracted lamp position, as in FIG. 1. Escaping air around the piston 36 space 37 produces the necessary dampening in both directions of piston travel and prevents the slamming of the piston surface 41 against the piston stop 38.

It should be clear at this time that the present invention provides an extendable and retractable light fixture which can be mounted in the earth and which advantageously provides a solenoid which simplifies the extension and retraction of the light fixture. However, it should also be clear that the present invention is not to be construed as limited to the forms shown which are to be considered illustrative rather than restrictive.

I claim:

1. A retractable light fixture comprising:

a housing having sides, and a bottom;

a lamp;

a solenoid attached inside said housing and coupled to said lamp for moving said lamp from said housing to an extended position when said solenoid is actuated;

an electrical conductor connected between an electrical power source and said solenoid and to said lamp for powering said lamp and solenoid;

said solenoid having a casing having a coil attached thereto for at least a portion of the length thereof for generating a magnetic field in said casing and said solenoid having an extendable solenoid arm having a slidable piston, said piston having a ledge formed by the connection to one end thereof the solenoid arm and said solenoid casing having a solenoid arm guide and stop member formed on one end portion of said casing to guide the solenoid solenoid arm during extension of the arm and to stop the extension of said solenoid arm when said slidable piston abuts against said solenoid arm guide and stop member; and latch means for holding said solenoid arm in an extended position, said latch means including a coil formed around said solenoid arm guide and stop member and said coil being coupled to an electrical conductor for producing an electrical magnet to hold said solenoid arm and piston in an extended position when said electrical conductor has an electrical voltage applied thereto, whereby said lamp can be raised and held in a raised position by the application of electrical power in said electrical conductor.

2. A retractable light fixture in accordance with claim 1 in which said solenoid arm guide and stop member forms an electric magnet when said latch means coil is actuated to hold said solenoid arm in an extended position.

3. A retractable light fixture in accordance with claim 2 in which a microswitch is attached to said housing to indicate when said lamp reaches a raised position to turn off the power to said solenoid arm in an extended position.

4. A retractable light fixture in accordance with claim 3 in which said solenoid arm is generally cylindrical and said piston is general cylindrical and said solenoid arm is a small diameter than said piston and forms an annular ledge where the solenoid arm connects to said piston whereby said annular ledge acts as a stop for the extension of said solenoid arm.

5. A retractable light fixture in accordance with claim 4 in which said solenoid arm guide and stop member is a cylindrical member attached to an open end of said solenoid casing and having an opening therethrough to guide said solenoid arm passing therethrough and to stop said piston from passing therethrough.

6. A retractable light fixture in accordance with claim 5 in which said solenoid guide and stop member has a generally truncated cone shaped surface around said opening the solenoid of arm guide and stop member.

7. A retractable light fixture in accordance with claim 6 in which said solenoid piston has a generally truncated cone surface at one end adjacent the connection with said solenoid arm and sized to engage said truncated cone surface of said solenoid arm guide and stop member.

8. A retractable light fixture in accordance with claim 7 in which said solenoid casing is generally cylindrical.

9. A retractable light fixture in accordance with claim 8 in which said lamp is fixedly attached to said lamp solenoid arm.

10. A retractable light fixture in accordance with claim 9 in which said solenoid is fixedly attached to said lamp housing.

11. A retractable light fixture comprising:

a housing having sides, a bottom and being open on one end thereof;

a cover covering an open end to said housing;

a lamp attached to said cover;

an electrically actuated solenoid forming a solenoid casing attached inside said housing and having a solenoid arm attached to said cover for raising said cover and lamp attached thereto to thereby extend said lamp outside said housing and for lowering said cover when said solenoid arm is retracted;

electrical conductor connected between an electrical source and to said solenoid and to said lamp for powering said lamp and solenoid, said electrical conductor having a remote switch therein;

latch means for holding said solenoid arm and said cover and lamp attached thereto in an extended position, said latch means including a first electric magnet powered by said electrical conductor, whereby said light fixture raises said lamp and turns said lamp on upon electrical power being applied to said light fixture by actuating said remote switch in said electrical conductor.

12. A retractable light fixture in accordance with claim 11 in which said solenoid includes a arm guide and stop member forming a second electric magnet when said first electric magnet is actuated to hold said solenoid arm in an extended position.

13. A retractable light fixture in accordance with claim 12 in which said solenoid arm is generally cylindrical and having a solenoid that piston is general cylindrical and said solenoid arm is a small diameter than said solenoid piston and forms an annular ledge where the solenoid arm connects to said solenoid piston whereby said annular ledge acts as a stop for the extension of said solenoid arm.

14. A retractable light fixture in accordance with claim 13 in which said solenoid arm guide and stop member is a cylindrical member attached to an open end of said solenoid casing and having an opening therethrough to guide said solenoid arm passing therethrough and to stop said solenoid piston from passing therethrough.

15. A retractable light fixture in accordance with claim 14 in which said solenoid arm guide and stop member has a generally truncated cone shaped surface around said opening of the solenoid arm guide and stop member.

16. A retractable light fixture in accordance with claim 15 in which said solenoid piston has a generally truncated cone surface at one end adjacent the connection with said solenoid arm and sized to engage said truncated cone surface of said solenoid arm guide and stop member.

17. A retractable light fixture in accordance with claim 16 in which said solenoid casing is generally cylindrical.

18. A retractable light fixture in accordance with claim 17 in which said solenoid has a solenoid coil wrapped around the solenoid casing and said second electric magnet has a coil wrapped around said solenoid casing and said solenoid coil of said solenoid and second electric magnet are connected to said element conductor to power both coils at the same time.

19. A retractable light fixture in accordance with claim 18 in which said lamp and cover are fixedly attached to said solenoid arm.

* * * * *